US006607366B2

(12) United States Patent
Sperry

(10) Patent No.: US 6,607,366 B2
(45) Date of Patent: Aug. 19, 2003

(54) VARIABLE CLEARANCE SYSTEM FOR RECIPROCATING COMPRESSORS

(75) Inventor: Lauren D. Sperry, Blue Springs, MO (US)

(73) Assignee: Gas and Air Specialty Products, Inc., Blue Springs, MO (US)

( * ) Notice: Subject to any disclaimer, the term of this patent is extended or adjusted under 35 U.S.C. 154(b) by 0 days.

(21) Appl. No.: 10/103,501

(22) Filed: Mar. 21, 2002

(65) Prior Publication Data

US 2002/0141884 A1 Oct. 3, 2002

Related U.S. Application Data

(63) Continuation-in-part of application No. 09/481,887, filed on Jan. 12, 2000, now Pat. No. 6,361,288.

(51) Int. Cl.[7] ..... F04B 49/00; F04B 39/10

(52) U.S. Cl. ..... 417/306; 417/307; 417/440; 417/443; 417/536; 137/522

(58) Field of Search ..... 417/306, 307, 417/298, 309, 440, 443, 536; 137/522

(56) References Cited

U.S. PATENT DOCUMENTS

| | | | | |
|---|---|---|---|---|
| 3,584,981 A | | 6/1971 | Worster | 417/542 |
| 3,791,776 A | * | 2/1974 | Grant | 417/440 |
| 4,043,710 A | | 8/1977 | Bunn et al. | 417/440 |
| 4,398,559 A | | 8/1983 | Bunn et al. | 137/516.15 |
| 4,445,824 A | | 5/1984 | Bunn et al. | 417/440 |
| 4,569,367 A | | 2/1986 | Petro | 137/596.13 |
| 4,710,108 A | * | 12/1987 | Soupal | 417/298 |
| 4,737,080 A | | 4/1988 | Owsley et al. | 417/275 |
| 4,819,689 A | | 4/1989 | Owsley et al. | 137/512.1 |
| 5,421,358 A | | 6/1995 | Jaeger | 137/1 |
| 5,695,325 A | | 12/1997 | Sperry | 417/443 |
| 5,984,645 A | * | 11/1999 | Cummings | 417/307 |

FOREIGN PATENT DOCUMENTS

| | | |
|---|---|---|
| JP | 62-178874 | 5/1987 |

* cited by examiner

*Primary Examiner*—Charles G. Freay
*Assistant Examiner*—Michael K. Gray
(74) *Attorney, Agent, or Firm*—Marcia J. Rodgers; Shughart Thomson & Kilroy, PC

(57) ABSTRACT

An unloader system is provided for a reciprocating gas compressor. The system includes an unloader valve assembly including a valve member controlling flow between compressor cylinder and a clearance bottle. Opening and closing of the valve member is controlled by manipulating a control pressure acting through a manifold against the stem of the valve member by means of a pressure regulator connected in series with a pressure source. When the pressure in the compressor cylinder acting on the heads of the poppet valve members exceeds the control pressure acting on the stems, the poppet valve members open, partially unloading the compressor.

12 Claims, 14 Drawing Sheets

PARTIAL USE OF FIXED VOLUME CLEARENCE

VARIABLE CLEARANCE SYSTEM FOR RECIPROCATING COMPRESSORS

CROSS REFERENCE TO RELATED APPLICATION

This application is a Continuation-in-Part of U.S. application Ser. No. 09/481,887, entitled VARIABLE CLEARANCE SYSTEM FOR RECIPROCATING COMPRESSORS, filed Jan. 12, 2000, which issued as U.S. Pat. No. 6,361,288 on Mar. 26, 2002.

BACKGROUND OF THE INVENTION

1. Field of the Invention

The present invention relates generally to unloaders for reciprocating gas compressors, and in particular to an unloader system that allows variable use of fixed or variable clearance volumes.

2. Description of the Related Art

Gas compressors are well known and various types have been utilized to meet the requirements of particular applications. For example, natural gas transmission through pipelines is often accomplished with large, reciprocating compressors driven by internal combustion engines at pumping stations located along the pipeline routes.

In natural gas transmission, the internal combustion engines which drive the compressors are often fueled by natural gas taken directly from the pipeline. Thus, the fuel consumed by the engines driving the compressors reduces the overall operating efficiency since the amount of gas delivered is reduced by amounts consumed in the transmission or pumping process.

Efficient operation of natural gas compressors typically involves the use of a computerized control system for controlling the air/fuel mixture, rotational speeds, etc. Another factor which has a significant effect on compressor operating efficiency relates to the extent to which the compressor is loaded. In fully-loaded operation, the maximum output of the compressor is achieved, with a resultant full load on the compressor engine. However, natural gas compressor flow demands can vary considerably, and typically depend on downstream demand factors and conditions.

Controlling compressor flow is often accomplished by partially "unloading" a compressor whereby each compressor stroke produces a reduced gas flow as compared to fully-loaded operation. Reduced gas flow generally corresponds to reduced work performed by the compressor engine, whereby fuel savings and greater efficiency can be achieved. Although compressor output could be varied by changing the speed of the driving engine, this approach is often impractical because the engines are designed to operate at constant speeds for maximum fuel efficiency and minimum emissions. Thus, compressor output control must normally be accomplished using other means.

A compressor can be partially unloaded and its output reduced by increasing the clearance volume. Clearance pockets or clearance bottles connected to the compressor cylinder via an unloader valve are often provided for this purpose. The clearance pocket may be built into the cylinder head or installed outboard of a respective suction or discharge valve.

Owsley et al., U.S. Pat. No. 4,737,080, which is incorporated herein by reference, discloses a valve assembly having valve members which are controlled by means of a pilot valve. The valve assembly is mounted in a respective suction or discharge valve pocket such that the valve members serve as intake or discharge valves for the compressor and also provide means for unloading the compressor. If, for example, the valve assembly is installed in the suction line of the compressor, the heads of the valve members are placed in communication with the respective suction line. A source of low pressure (such as the atmosphere) is selectively applied to the stems of the valve members through the pilot valve to create a pressure differential across the valve members which results in the valve members being forced into an open condition and held open. With the valve members thus held open, the compressor cylinder is placed in continuous communication with the suction line, fully unloading the compressor.

An alternative embodiment of the valve assembly of Owsley et al. adds a clearance bottle and an annular secondary valve assembly to the device. The clearance bottle is positioned over the valve assembly such that the valve members previously described act as primary valve members which control flow between the cylinder and the clearance bottle. The secondary valve assembly includes secondary valve members which control flow between the clearance bottle and the suction line. The primary and secondary valve members are all selectively controlled by the pilot valve, which is a three way valve.

In a fully-loaded operating condition the secondary valve members allow flow between the suction line and the primary valve members. The primary valve members are allowed to operate as the suction valves (i.e, to close on the compression stroke and open on the suction stroke of the compressor). In a fully-unloaded condition, both the primary and secondary valves are held open, thereby placing the compressor cylinder in continuous communication with the suction line. In the third possible position of the pilot valve, the primary valve members are held open and the secondary valve members are allowed to function as the suction valves. This, in effect, adds the entire volume of the clearance bottle to the clearance volume of the compressor cylinder and thereby partially unloads the compressor.

A problem with this type of clearance bottle unloader system is that the operation of the unloader is simply and on/off selection, meaning that the bottle is either in continuous communication with the compressor cylinder, or it remains out of communication with the compressor cylinder. The device has no capability for allowing partial use of the clearance bottle between the open and closed conditions.

Sperry, U.S. Pat. No. 5,695,325, which is incorporated herein by reference, discloses an unloader system wherein the compressor may be unloaded in small increments during operation by rotating a valve guard mounting the valve members in synchronization with the compressor crankshaft. This is accomplished using a stepper motor keyed to the compressor's crankshaft position to actuate a radial unloader valve assembly. While this arrangement does allow the compressor to be loaded and unloaded incrementally, the mechanism is rather complex and not suited for every compressor unloading application.

The present invention relates to pneumatically loading and unloading a reciprocating compressor in a smooth, stepless manner. This is accomplished by using a controlled pressure to hold the unloader valve members closed until the pressure in the compressor cylinder reaches the desired level. By adjusting the set point of a pressure regulator, the effective use of any shape and size of clearance cavity can be smoothly varied from zero impact to full impact.

Heretofore there has not been a compressor unloader system available with the advantages and features of the present invention.

SUMMARY OF THE INVENTION

In the practice of the present invention, an unloader system is provided for a reciprocating gas compressor having a cylinder, a piston reciprocally mounted in the cylinder, a suction line, a discharge line, a suction valve assembly and a discharge valve assembly for selectively communicating the suction and discharge lines respectively with the compressor cylinder. The unloader system includes a clearance cavity in communication with the compressor cylinder though a passageway and an unloader valve assembly having one or more valve members moveable between open and closed positions and controlling flow through the passageway. The valve members each have opposed first and second ends with the first ends being acted on by pressure in the compressor cylinder. The cylinder pressure produces a first force which acts to urge the valve members toward their open positions.

A conduit communicates the second ends of the valve members with a pressure regulator. The regulator is also in communication with a pressure source. Pressure from the pressure source is selectively varied by the pressure regulator to create a control pressure which acts on the second ends of the valve members to produce a second force which acts in opposition to the first force and urges the valve members toward their closed positions. The valve members open when the first force exceeds the second force and close when the second force exceeds the first force.

DETAILED DESCRIPTION OF THE PREFERRED EMBODIMENTS

I. Introduction and Environment

Figure 1:
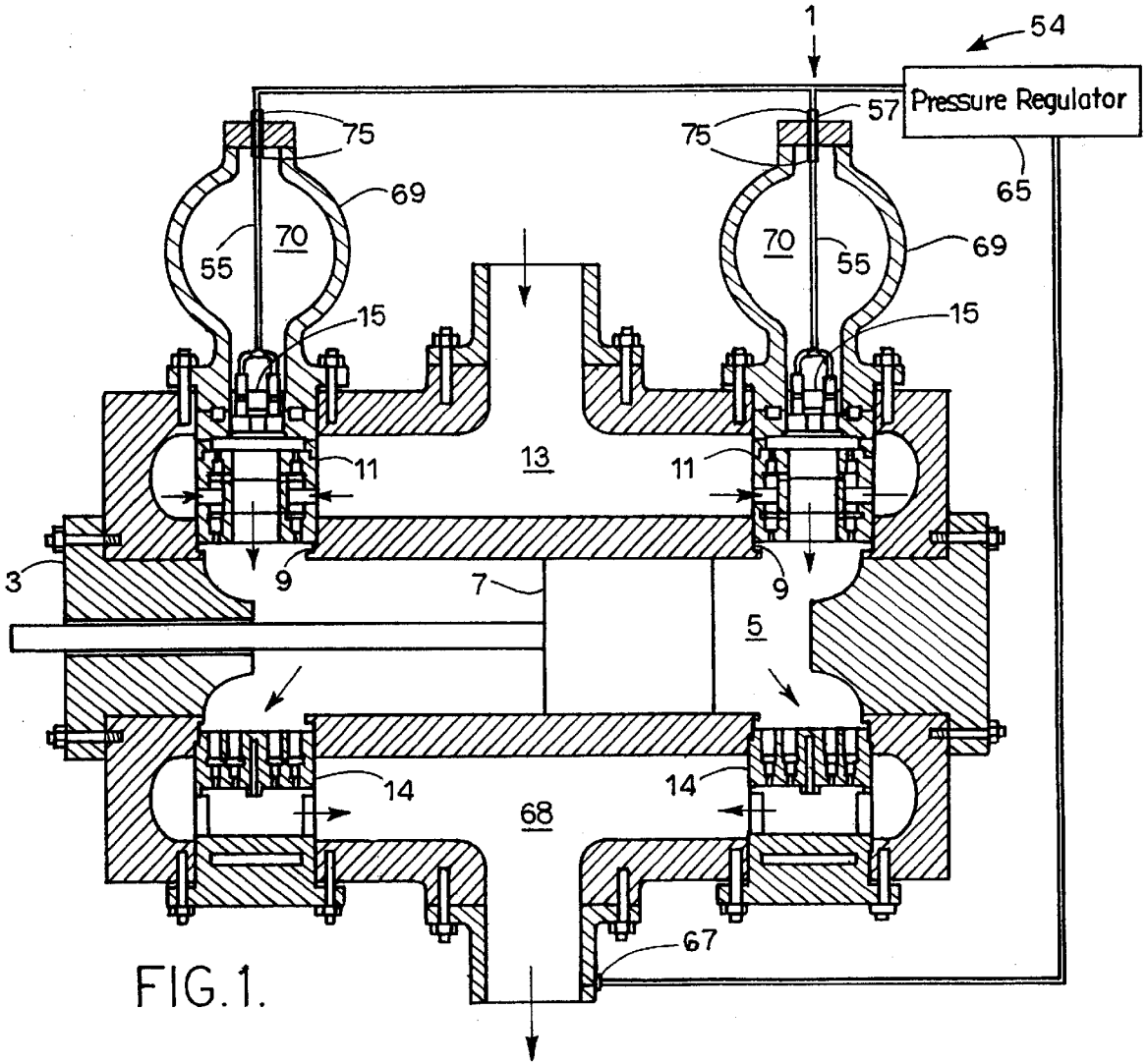
FIG. 1 is a cross-sectional view of a reciprocating gas compressor with the unloader system embodying the present invention installed in two suction valve pockets thereof.
Figure 2:
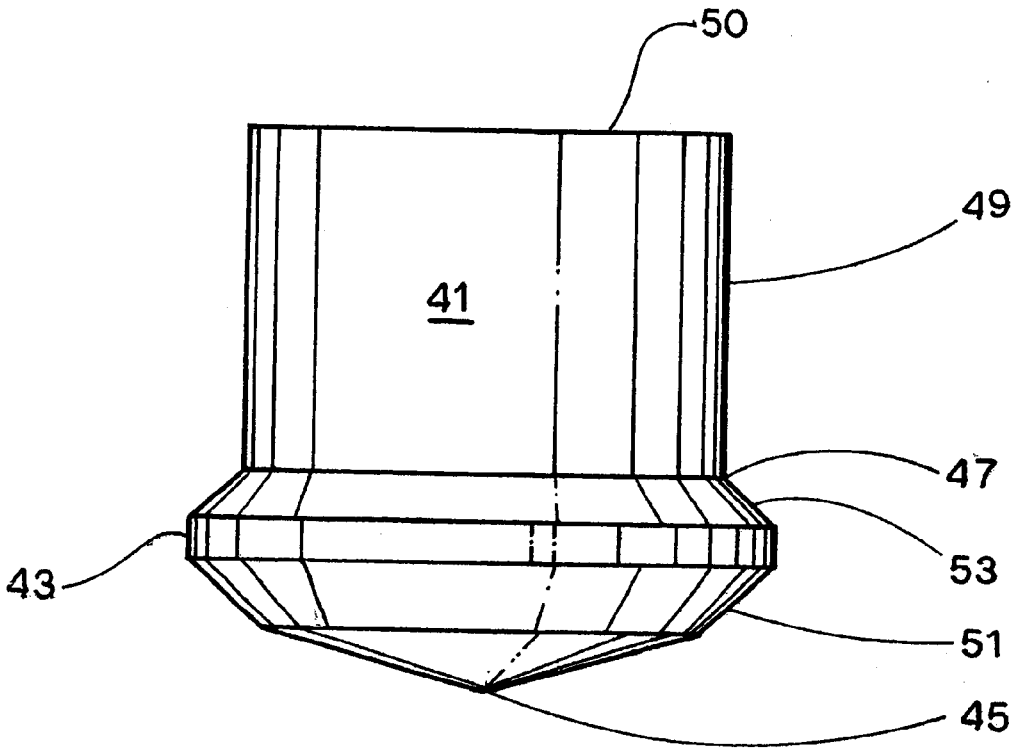
FIG. 2 is an enlarged, cross-sectional view of a poppet valve member thereof.
Figure 3:
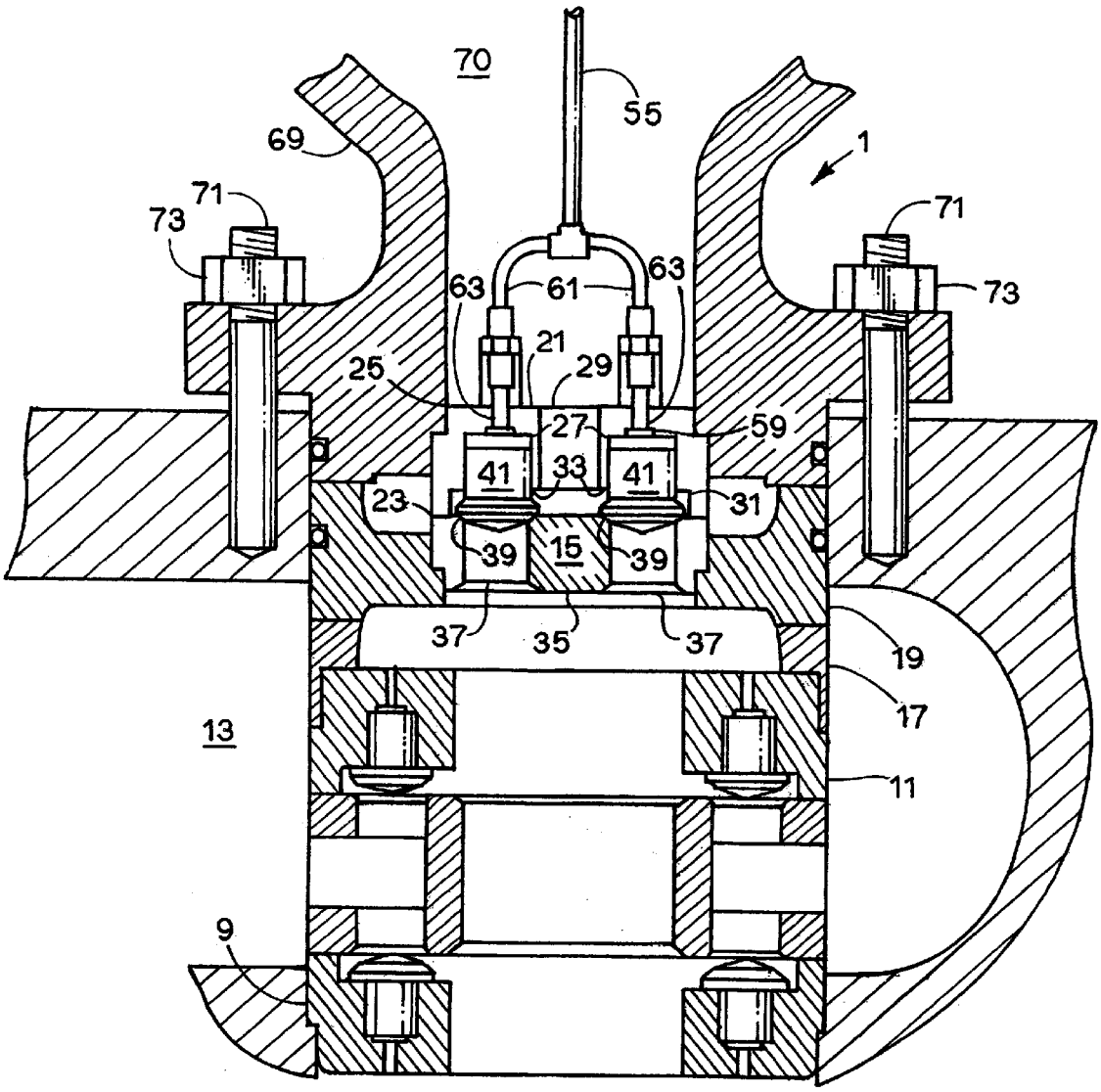
FIG. 3 is a partial, enlarged, cross-sectional view of an unloader system including the clearance bottle and the suction valve assembly thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

In particular, the preferred embodiments disclosed herein and illustrated in the drawings all show unloader valve assemblies with poppet valve members. This use of poppet valve members is for illustrative purposes only and should not be considered to be limiting. The present invention could be embodied with other types of valves such as plate valves (circular rings sealing over circular slots) or strip valves (flat or curved strips sealing over linear slots).

Referring to the drawings in more detail, the reference number 1 generally designates an unloader system embodying the present invention. The unloader system 1 is adapted for use in connection with a reciprocating compressor 3 including a cylinder 5 reciprocably receiving a piston 7. Suction valve pockets 9 are formed at either end of the cylinder 5. Suction valve assemblies 11, installed in the suction valve pockets 9, selectively communicate the suction line 13 with the cylinder 5. Discharge valve assemblies 14 selectively communicate the cylinder 5 with the discharge line 68.

II. Unloader System 1

The unloader system 1 includes an unloader valve assembly 15 which is mounted in a suction valve pocket 9 by means of an adapter 17 and a reducer 19, placing it in communication with the cylinder 5 through the suction valve assembly 11. The unloader valve assembly 15 includes a valve guard 21 having inboard and outboard sides 23, 25, one or more poppet valve stem bores 27, a fluid passage 29, and a valve head clearance 31. Each poppet valve stem bore 27 has a chamfered valve seat 33.

A valve seat structure 35 is mounted to the inboard side 23 of the valve guard 21. The valve seat structure 35 has seat passages 37 in alignment with the valve stem bores 27 in the valve guard 21. Each valve seat passage 37 has a chamfered valve seat 39.

Respective poppet valve members 41 are moveably mounted in each of the valve stem bores 27. Each poppet valve member 41 has a head 43 with an inboard side 45 and an outboard side 47; and a stem 49 having a face 50. The inboard side 45 of the head 43 has a beveled seating surface 51 for engaging the chamfered valve seat 39 of the seat passage 37 in the poppet valve member's closed position. The outboard side 47 of the head 43 has a similar beveled seating surface 53 for engaging the chamfered valve seat 33 of the poppet valve stem bore 27 in the poppet valve member's open position. Preferably, the poppet valve members 41 will be made of a non-metallic material, as this will help to prevent damage to the chamfered valve seats 33, 39 caused by repeated contact with the poppet valve members 41, however metallic valve members 41 may also be used.

The unloader valve assembly 15 may include pressure relief grooves as disclosed by Bunn et al. U.S. Pat. No. 4,398,559 or head-guided poppet valve members as disclosed by Owsley et al. U.S. Pat. No. 4,819,689. Those patents are incorporated herein by reference.

The unloader valve assembly 15 opens and closes in response to the pressure differential acting on opposing sides of the poppet valve member 41 (i.e., on the valve stem face 50 and the inboard side 45 of the head 43). The pressure acting on the inboard side 45 of the head 43 is the pressure $P_{cyl}$ within the cylinder 5 of the compressor 3, which is an operating condition of the compressor 3 and varies with the cycling of the compressor 3.

The pressure $P_{ctrl}$ acting on the valve stem face 50 is governed by a control system 54 which is fully described herein as being pneumatic, but which could also be hydraulic or electro-mechanical. In the pneumatic version, a control manifold 55, having an outboard end 57 and an inboard end 59 with a branch 61 for each poppet valve stem bore 27, communicates with the poppet valve stem bores 27 through ports 63 in the inboard side 23 of the valve guard 21. The outboard end 57 of the control manifold 55 is in communication with a pressure regulator 65, which is also in communication with a pressure source 67.

The pressure regulator 65 can be adjusted to vary the control pressure set point $P_{ctrl}$ in response to the operating conditions of the compressor 3. These operating conditions can include downstream demand for natural gas, the fuel consumption of the engine driving the compressor, the level of exhaust emissions from the engine driving the compressor or the concentration of any selected component of those emissions (such as NOX), rotational speed of the compressor, compressor crankshaft position, pressure within the cylinder $P_{cyl}$, suction pressure $P_{suct}$, discharge pressure $P_{disc}$, or any other condition which might dictate the desired output of the compressor 3.

If the poppet valve stem bores 27 and the seat passages 37 are the same diameter, then substantially identical pressures acting on the identical cross sectional areas (i.e., on the valve stem face 50 and the inboard side 45 of the head 43 of the poppet valve member 41) will produce the same force. In this configuration, the pressure source 67 could be the discharge line 68 of the compressor 3, because the discharge pressure $P_{disc}$ would theoretically represent the highest pressure that should be required to operate the unloader system 1, although slightly higher pressures might be required to overcome valve resistance and inertia of the poppet valve members 41.

Each poppet valve member 41 can optionally be equipped with a helical return spring 52 for biasing it towards its closed position. Alternatively, springs can be provided for biasing the poppet valve members towards their open positions. If springs 52 are included, then factors such as a spring constant ("K") could affect the unloader control pressure set points.

A clearance bottle 69 is fastened over the suction valve pocket 9 by means of studs 71 and nuts 73. The interior of the clearance bottle 69 defines a clearance cavity 70. As the nuts 73 are tightened, the suction valve assembly 11, the adapter 17, the reducer 19, the unloader valve seat structure 35, the unloader valve guard 21, and the clearance bottle 69 are drawn together and firmly positioned in the suction valve pocket 9. The control manifold 55 passes through the clearance bottle 69, and the joint is sealed with pressure-tight fittings 75.

In operation, the pressure regulator 65 is adjusted to a control pressure set point $P_{ctrl}$, holding the poppet valve members 41 in their closed positions. When the poppet valve members 41 are in their closed positions, the clearance cavity 70 is isolated from the compressor cylinder 5. As the piston 7 approaches the top of the cylinder 5, the pressure $P_{cyl}$ in the cylinder 5 builds until it exceeds the control pressure set point $P_{ctrl}$, at which point the poppet valve members 41 are forced open, partially unloading the compressor 3 by placing the cylinder 5 in communication with the clearance cavity 70. In the open position, the outboard beveled seating surfaces 53 of poppet valve members 41 are pressed firmly against the chamfered valve seats 33 of the valve guard 21, sealing the control manifold 55 off from the clearance cavity 70. By adjusting the pressure regulator 65, the poppet valve members 41 can be set to open at any point in the stroke of the piston 7.

It should be noted that while this discussion only describes the pressure regulator 65 controlling a single unloader valve assembly 15 per stage of the compressor 3, one pressure regulator 65 can be used to control multiple unloader valve assemblies 15 on a single stage of the compressor 3. Each unloader valve assembly 15 may be in communication with a separate clearance bottle 69.

III. First Modified Embodiment Unloader System 101

Figure 4:
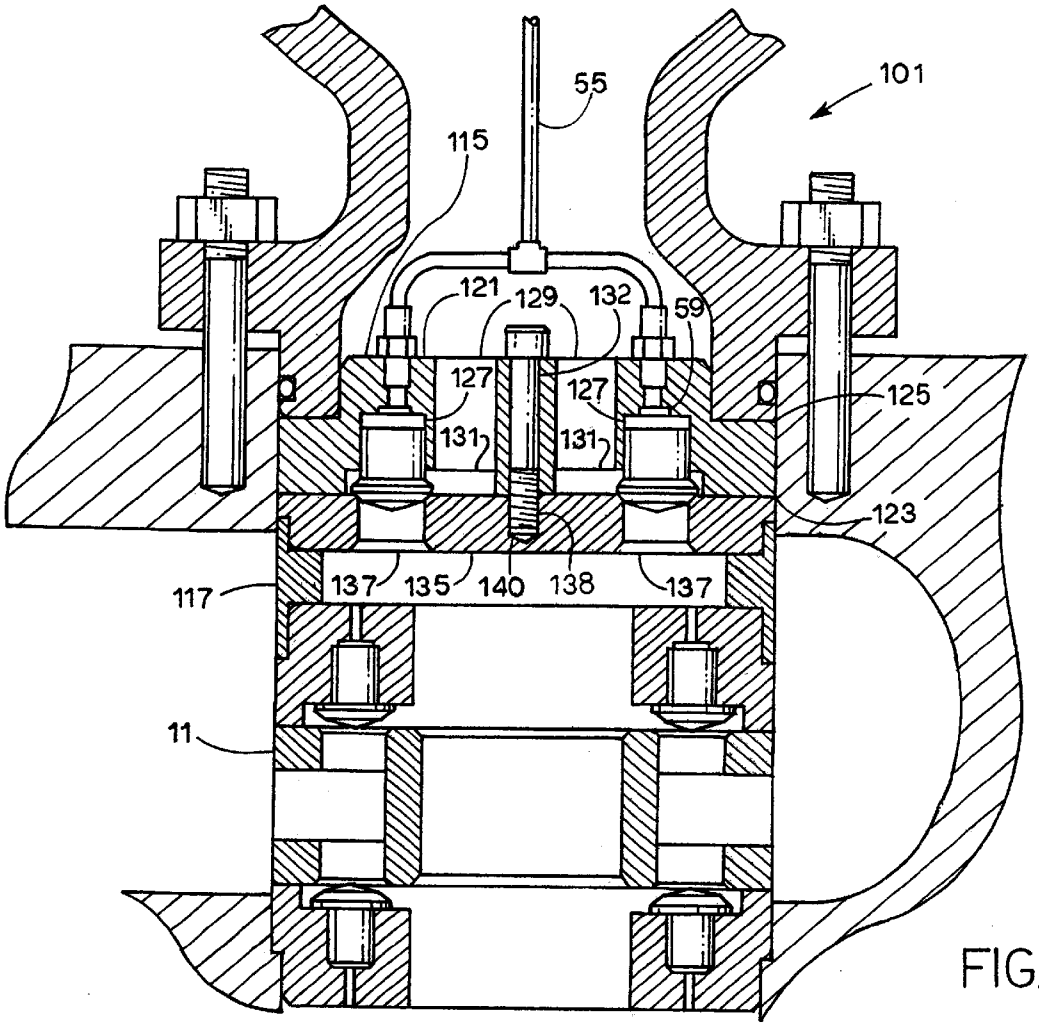
FIG. 4 is a partial, enlarged, cross-sectional view of an unloader system comprising a first modified embodiment of the present invention including a modified unloader valve assembly.

An unloader system 101 comprising a first modified embodiment of the present invention is shown in FIG. 4 and includes an unloader valve assembly 115 which is mounted in the suction valve pocket 9 by means of an adapter 117. The unloader valve assembly 115 includes a valve guard 121 having inboard and outboard sides 123, 125, and one or more poppet valve stem bores 127. Each poppet valve stem bore 127 is associated with a fluid passage 129, and a valve head clearance 131. The valve guard 121 has one or more fastener receivers 132.

A valve seat structure 135 is mounted to the inboard side 123 of the valve guard 121. The valve seat structure 135 has seat passages 137 in alignment with the valve stem bores 127 of the valve guard 121 and one or more threaded receivers 138 in alignment with the fastener receivers 132 of the valve guard 121. A respective axial attaching bolt 140 passes through each fastener receiver 132 of the valve guard 121 and threadably engages the respective threaded receiver 138 of the valve seat structure 135.

IV. Operation of the Unloader System 1 or 101

Figure 5:
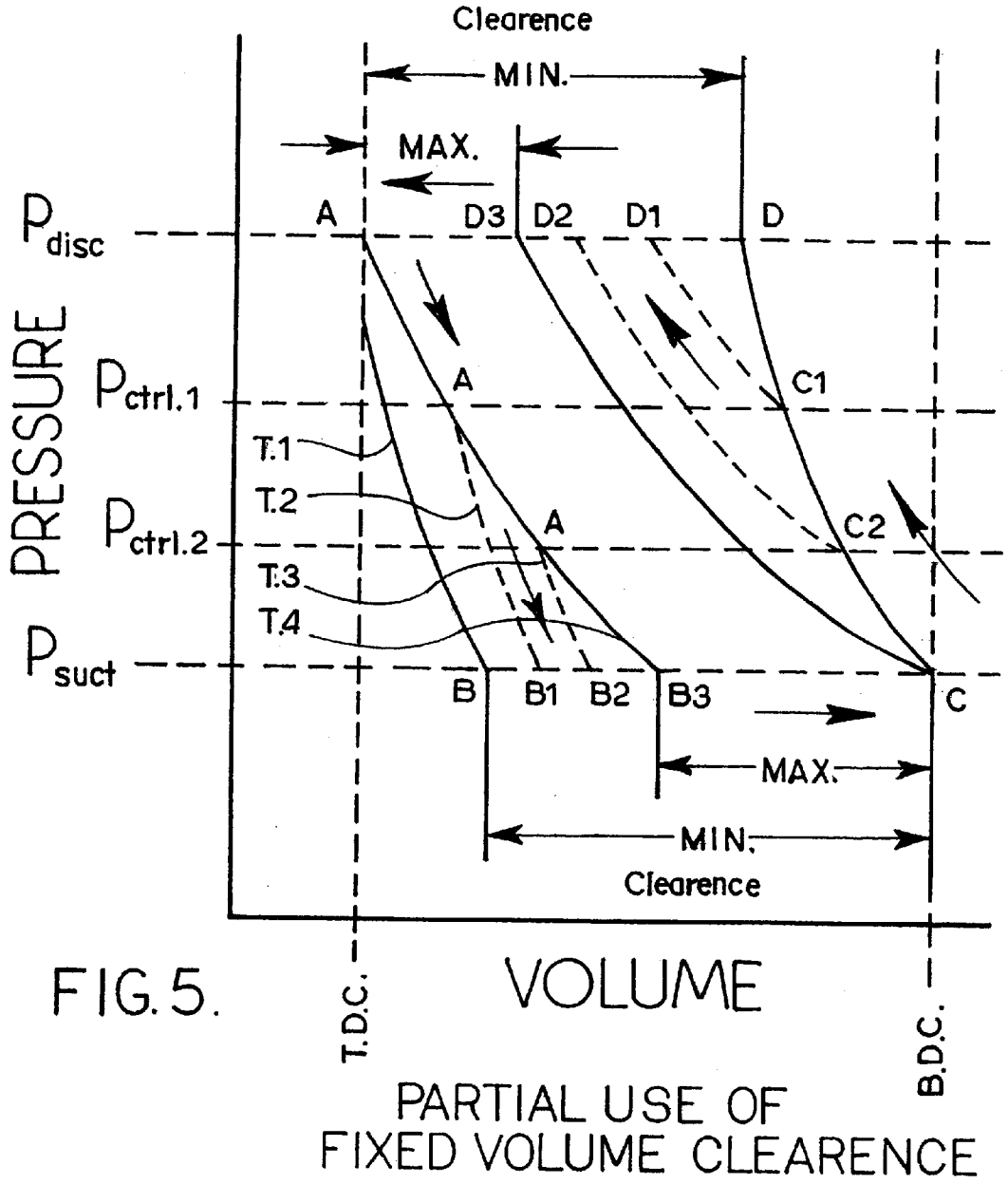
FIG. 5 is a Pressure-Volume (PV) graph or trace showing the operation of the unloader system.

The operation of the compressor 3 and the unloader system 1 is represented by a pressure/volume graph, commonly referred to as a "PV trace". FIG. 5 shows a PV trace depicting pressure and volume conditions with various conditions of the clearance cavity 70 communicating with the cylinder 5. It should be noted that FIG. 5 is a theoretical depiction of the perfect operation of the compressor 3 and makes no allowances for resistance from friction and inertia of the poppet valve members 41.

Trace T.1 (A–B–C–D–A) represents a fully-loaded, minimum clearance operating condition with the clearance cavity 70 closed off from the cylinder 5. PV trace T.4 (A–B3–C–D3–A) depicts a maximum clearance condition with the clearance cavity 70 in continuous communication with the compressor cylinder 5. The highest pressure attained at any point in the cycle is the discharge pressure $P_{disc}$ which represents the pressure in the discharge line 68. The lowest pressure in the cycle is the suction line pressure $P_{suct}$.

Intermediate PV traces T.2 and T.3 show how the cycle can be modified by employing the unloader system 1. Trace T.2 (A–A1–B1–C–C1–D1–A) represents the unloader valve assembly 15 being opened at C1 and closed at A1. This can be accomplished by setting the pressure regulator 65 to a control pressure set point $P_{ctrl.1}$. Both opening and closing would occur at approximately the same pressure as depicted by the location of A1 and C1 on the same pressure line in FIG. 5.

Figure 5A:
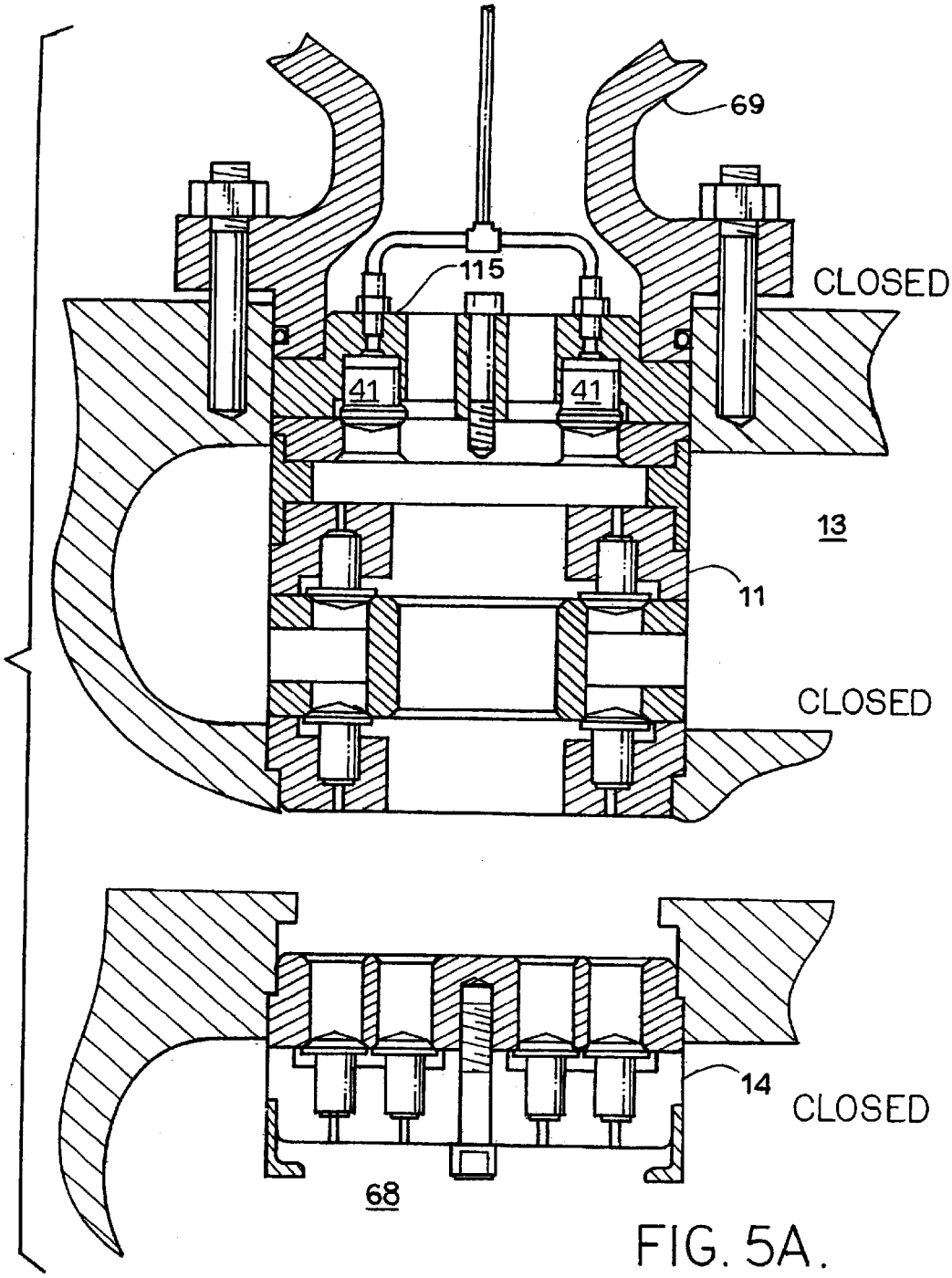
FIG. 5*a* is an enlarged, cross-sectional view showing the unloader valve assembly closed, the suction valve assembly closed and the discharge valve assembly closed.
Figure 5B:
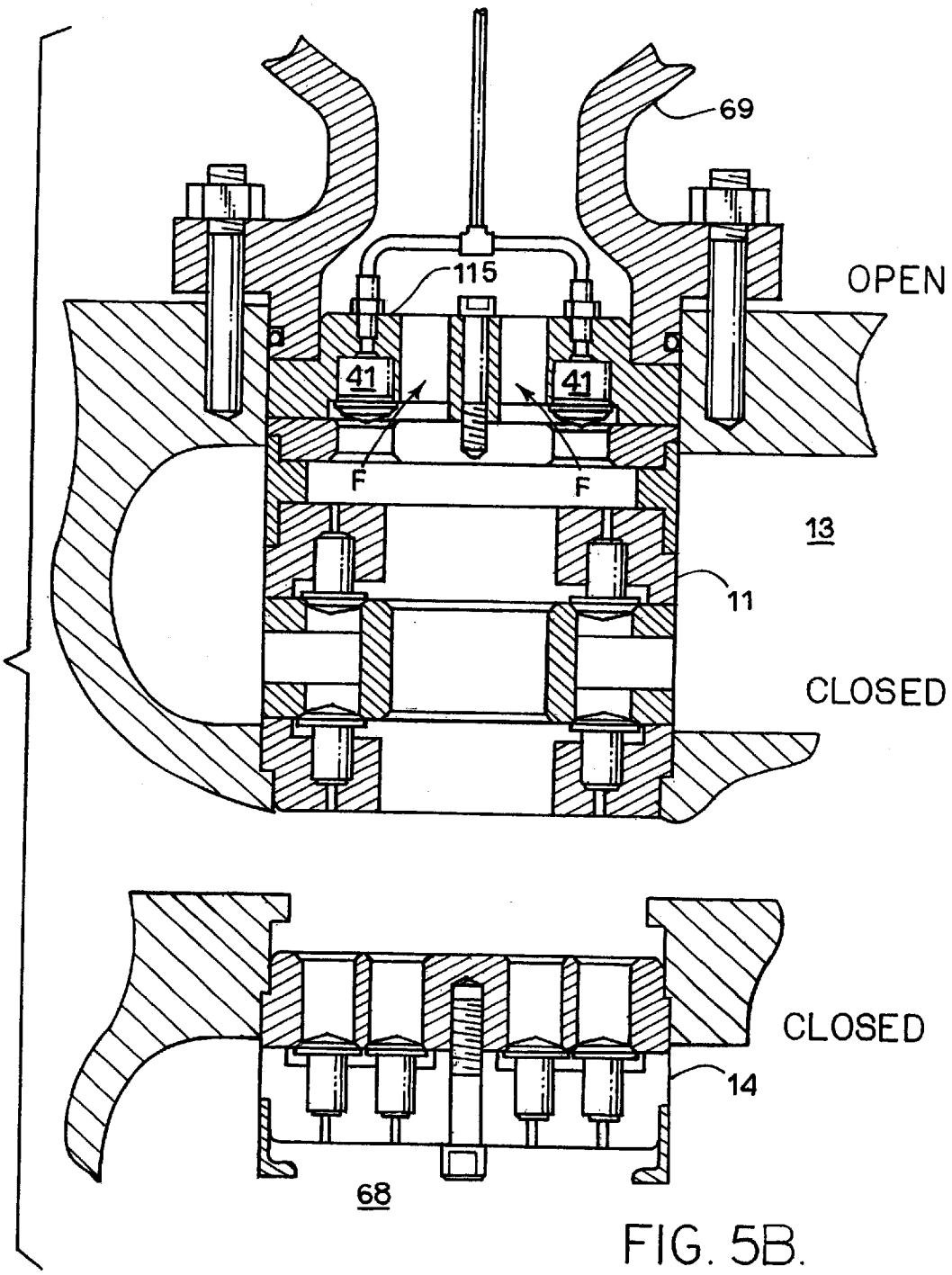
FIG. 5*b* is an enlarged, cross-sectional view showing the unloader valve assembly open, the suction valve assembly closed and the discharge valve assembly closed.

Following trace T.2 in detail, point C represents the beginning point of the cycle. The piston 7 is at bottom dead center; the intake valve assembly 11, the unloader valve assembly 15, and the discharge valve assembly 14 are all closed. This arrangement of the valves is depicted in FIG. 5*a*. Moving along trace T.2 from C to C1, the piston 7 has begun its compression stroke and the pressure in the cylinder 5 begins to rise. At point C1 the pressure in the cylinder 5 reaches the control pressure set point $P_{ctrl.1}$ and the poppet valve members 41 of the unloader valve assembly 15 are forced open. This second arrangement of the valves is shown in FIG. 5*b*, with fluid flow through the valves being indicated by arrows F. The opening of the unloader valve assembly 15 increases the clearance volume of the compressor 3 and slows the rate at which the pressure in the cylinder 5 is rising. This shifts the PV trace off of line C1–D and onto line C1–D1.

Figure 5C:
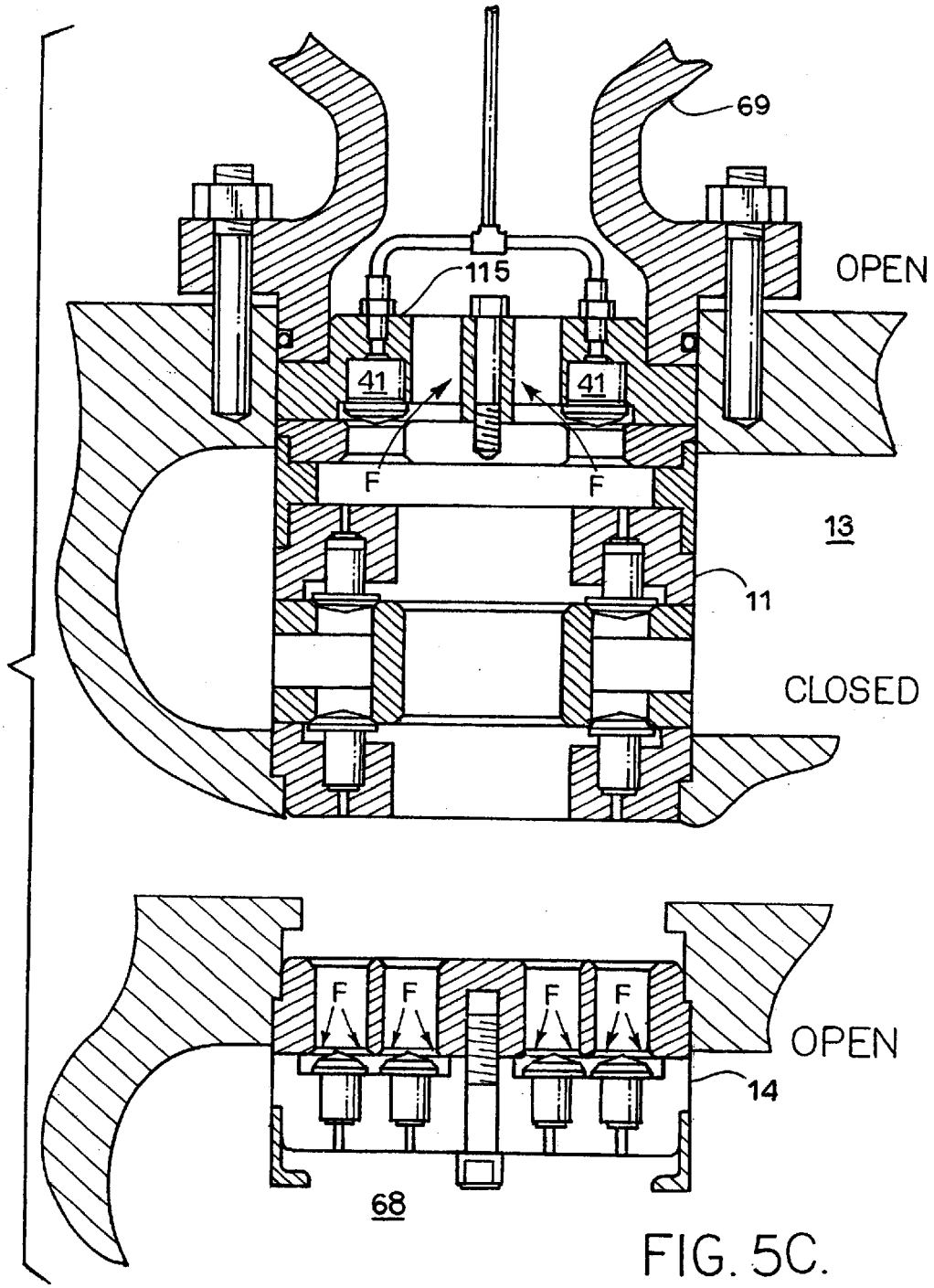
FIG. 5*c* is an enlarged, cross-sectional view showing the unloader valve assembly open, the suction valve assembly closed and the discharge valve assembly open.

At point D1 the discharge valve assembly 14 opens (FIG. 5*c*) and the pressure in the cylinder 5 reaches its maximum level $P_{disc}$. The piston 7 continues its travel until it reaches top dead center at point A. At point A the discharge valve 14 closes (FIG. 5*b*) and the piston 7 begins its expansion stroke (moving from A toward A1) and the pressure in the cylinder 5 begins to drop. At point A1 the pressure in the cylinder 5 again reaches the control pressure set point $P_{ctrl.1}$ and the poppet valve members 41 of the unloader valve assembly 15 are allowed to close (FIG. 5*a*). The closing of the unloader valve assembly 15 decreases the clearance volume and thereby increases the rate at which the pressure in the cylinder 5 is dropping and shifts the PV trace off of line A1–B3 and onto line A1–B1. Because the poppet valve members 41 only travel a short distance between the open and closed positions, any delay involved in the shifting of the PV trace is minimal.

Figure 5D:
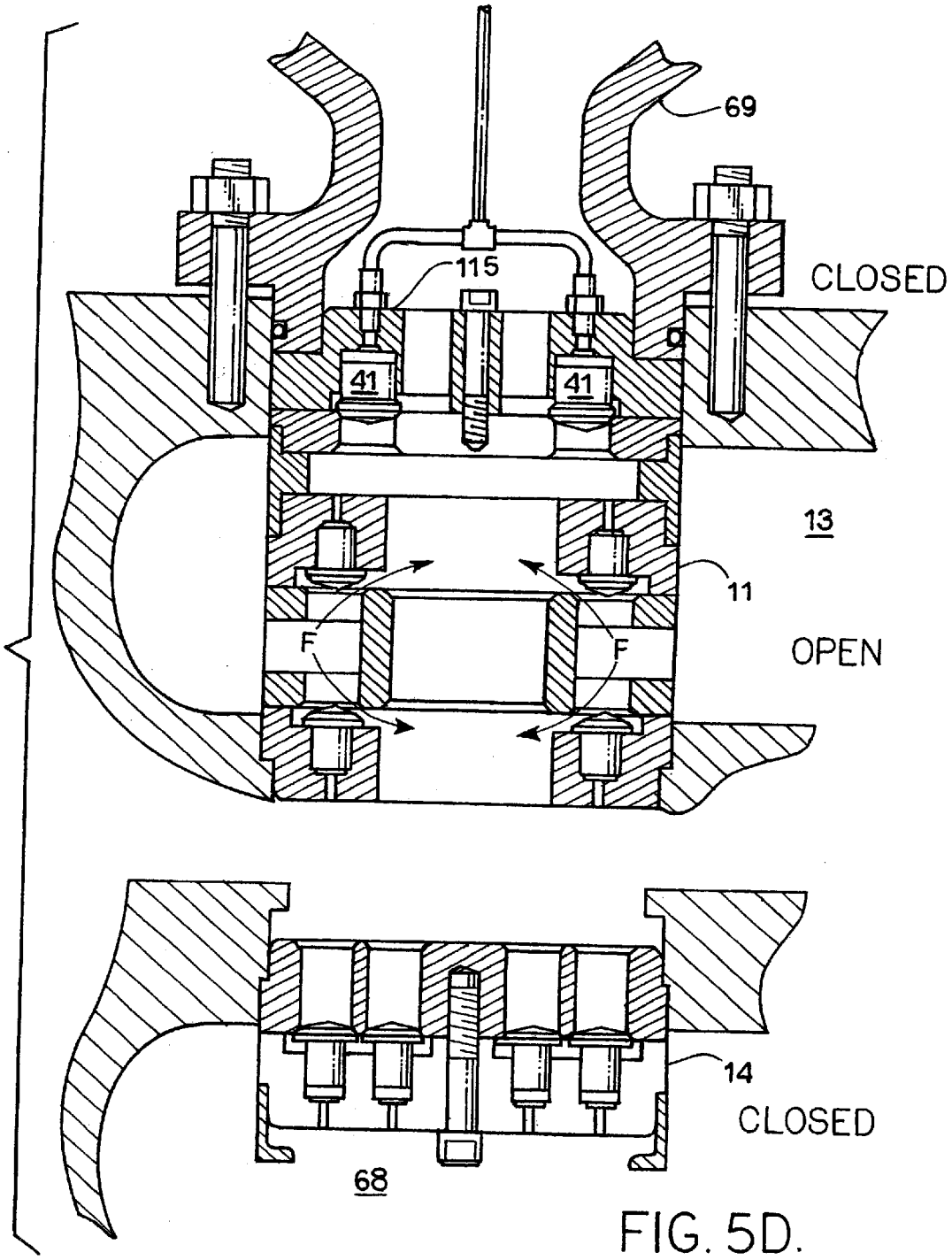
FIG. 5*d* is an enlarged, cross-sectional view showing the unloader valve assembly closed, the suction valve assembly open and the discharge valve assembly closed.

At point B1 the suction valve assembly 11 opens (FIG. 5*d*), and the pressure in the cylinder 5 reaches its minimum level, $P_{suct}$. The piston 7 continues its travel until it again reaches bottom dead center at point C, at which point the suction valve assembly 11 closes.

Trace T.3 (A–A2–B2–C–C2–D2–A) represents opening and closing the unloader valve assembly 15 at a lower pressure $P_{ctrl.2}$, corresponding to a greater flow reduction through the compressor 3. The control pressure set point $P_{ctrl}$ can be infinitely varied between the suction line pressure $P_{suct}$ and the discharge pressure $P_{disc}$. This allows the operating cycle of the compressor to be precisely tailored to meet its demands by simply adjusting the pressure regulator 65.

V. Test Results

Initial field testing has been performed on a Worthington UTC-7 compressor operating between 600 psi suction and 850 psi discharge. The test was conducted on the crank end of one of three compressor cylinders using a single 1160 cubic inch clearance pocket designed to be used as a fully open or fully closed pocket. By adjusting the control pressure set point $P_{ctrl}$ within the design range, the horsepower and flow were varied as shown in Table 1. The left hand column of Table 1 shows the crank end horsepower required to run the compressor; the second column shows the discharge flow rate from the crank end, and the third column shows the horsepower required per unit of flow from the crank end. The right hand column shows the horsepower required per unit of flow from the head end of the compressor, which was not fitted with the variable clearance system 1.

The top row of Table 1 depicts the minimum load performance of the compressor with the control pressure set to hold the unloader valve assembly open throughout the cycle of the compressor. Succeeding rows show performance as the unloader valve assembly closes off the clearance cavity at progressively earlier points in the cycle. The bottom row shows fully loaded performance with the clearance pocket isolated from the cylinder throughout the cycle except during the discharge event.

TABLE 1

| CE Horsepower | CE Flow (MMSCFD) | CE HP/MM | HE HP/MM |
|---|---|---|---|
| 123.6 (pocket open) | 7.50 | 16.48 | 16.00 |
| 128.8 | 7.83 | 16.45 | 16.10 |
| 136.9 | 8.30 | 16.49 | 16.25 |
| 150.4 | 9.26 | 16.24 | 16.32 |
| 158.2 | 10.07 | 15.71 | 16.16 |
| 174.5 (pocket closed) | 10.94 | 15.95 | 15.89 |

The test results indicate that the variable clearance system 1 can be used effectively to vary the flow rate from a reciprocating compressor to meet the requirements of its specific operating conditions. There was some variation in HP/MM (which is a measure of efficiency) on the crank end, but not significantly different than was present on the head end of the same cylinder that had no load changes occurring. The slight changes could have resulted from small incidental changes in the operating conditions. It appears that there is really no limit on applying this system to reciprocating compressors. It has been tested to document the ability to effectively vary the clearance of fixed cavity size pockets. This can certainly be adapted to effectively vary the clearance on the head end pockets on high speed compressors. This allows most any compressor to be fully automated, with improved fuel consumption (or improved power draw if the compressor is electrically driven) and reduced emissions resulting from the smoother loading and unloading.

VI. Second Modified Embodiment Unloader System 201

Figure 6:
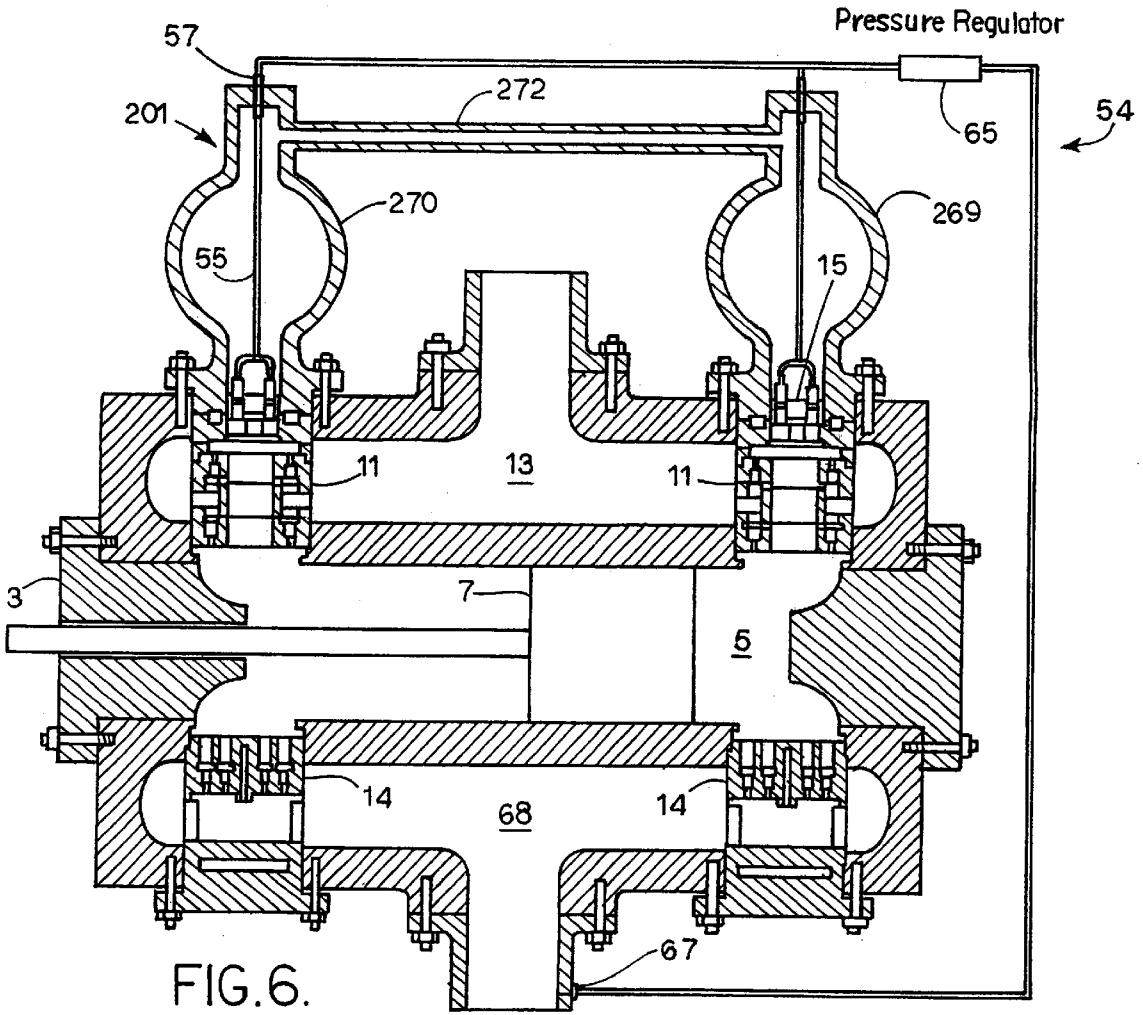
FIG. 6 is a cross-sectional view of a reciprocating gas compressor with an unloader system comprising a second modified embodiment of the present invention with fluidically interconnected clearance bottles.

An unloader system 201 comprising a second modified embodiment of the present invention is shown in FIG. 6. Suction valve assemblies 11 and unloader valve assemblies 15 are installed in both suction valve pockets 9 of the compressor cylinder 5. Clearance bottles 269 and 270 are mounted in communication with the unloader valve assemblies 15. A runner 272 interconnects the clearance bottles 269 and 270.

By interconnecting the clearance bottles 269 and 270, the available clearance volume is significantly increased. There is no risk of short-circuiting the compressor because the two unloader valve assemblies 15 will never be open at the same point in the compressor cycle.

VII. Feedback Control System

Figure 7:
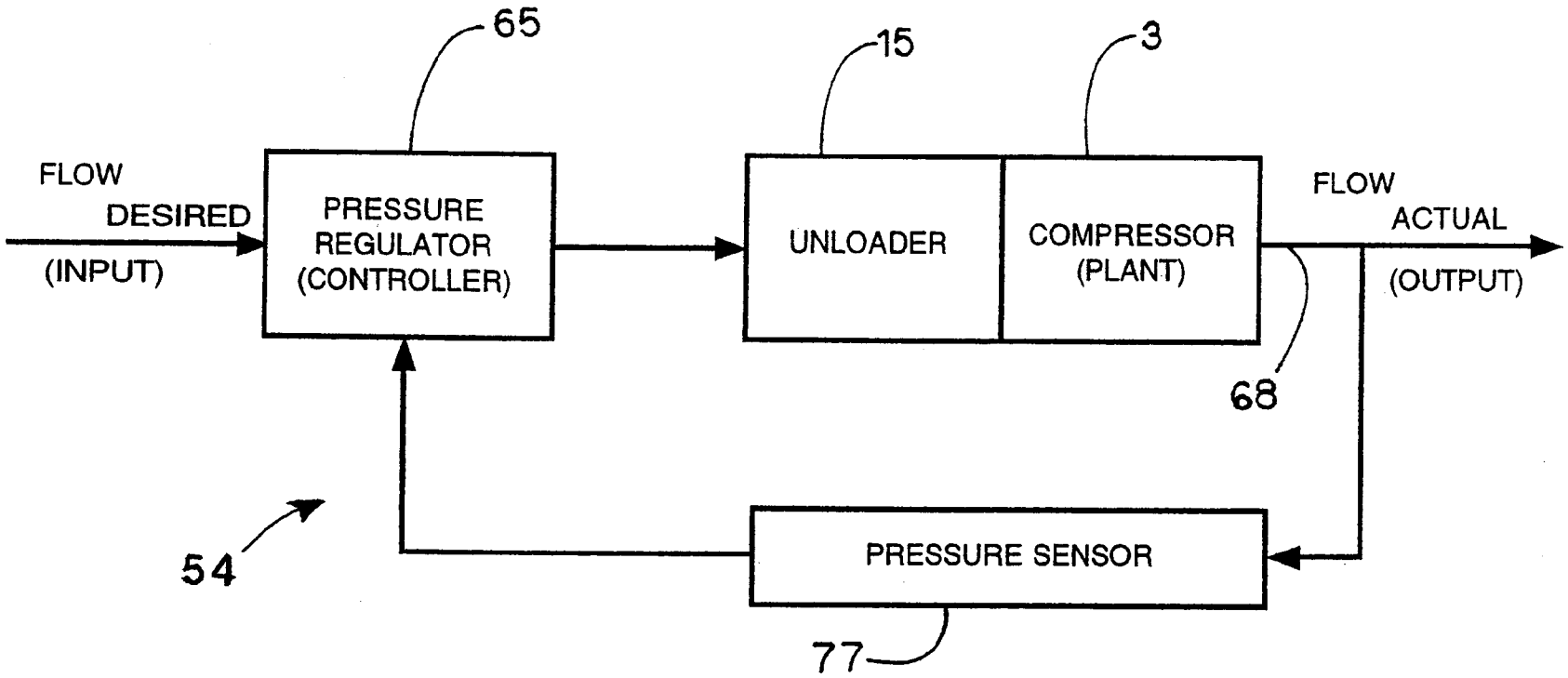
FIG. 7 is a block diagram of a closed-loop feedback control system for controlling the operation of the compressor by means of the unloader system of the present invention.

The pressure regulator 65 can be a mechanical, analog electrical or digital electronic device which may be controlled manually or electronically. An example of a suitable electronic pressure controller would be the ER3000 series produced by the TESCOM Corporation of Elk River, Minn. If a pressure sensor 77 is added to the system and placed in communication with the discharge line 68 of the compressor 3 then a closed-loop feedback control system can be created. A block diagram of such a system is shown in FIG. 7.

For each set of operating conditions, the operator of the system can determine an optimum flow which is calculated to most efficiently meet the downstream demand for natural gas, and this desired flow becomes the input for the control system. The desired flow corresponds to a desired discharge pressure $P_{disc}$. This information is communicated to the controller of the pressure regulator 65, which determines the proper control pressure set point $P_{ctrl}$ to achieve the desired discharge pressure $P_{disc}$. The pressure regulator 65 is then adjusted to the new control pressure set point $P_{ctrl}$ which effects the timing of the opening and closing of the unloader valve assembly 15. Any change in the timing of the unloader valve assembly 15 directly effects the actual flow from the discharge line 68 of the compressor 3 which is the output of the system.

The pressure sensor 77 reads the actual discharge line pressure $P_{disc}$ and the actual pressure is compared to the desired pressure. If the actual pressure is not the same as the desired pressure, this information is communicated back to the pressure regulator 65 and the control pressure set point $P_{ctrl}$ can be adjusted to compensate for the difference.

VIII. Split Pressure Source Control System 301

Figure 8:
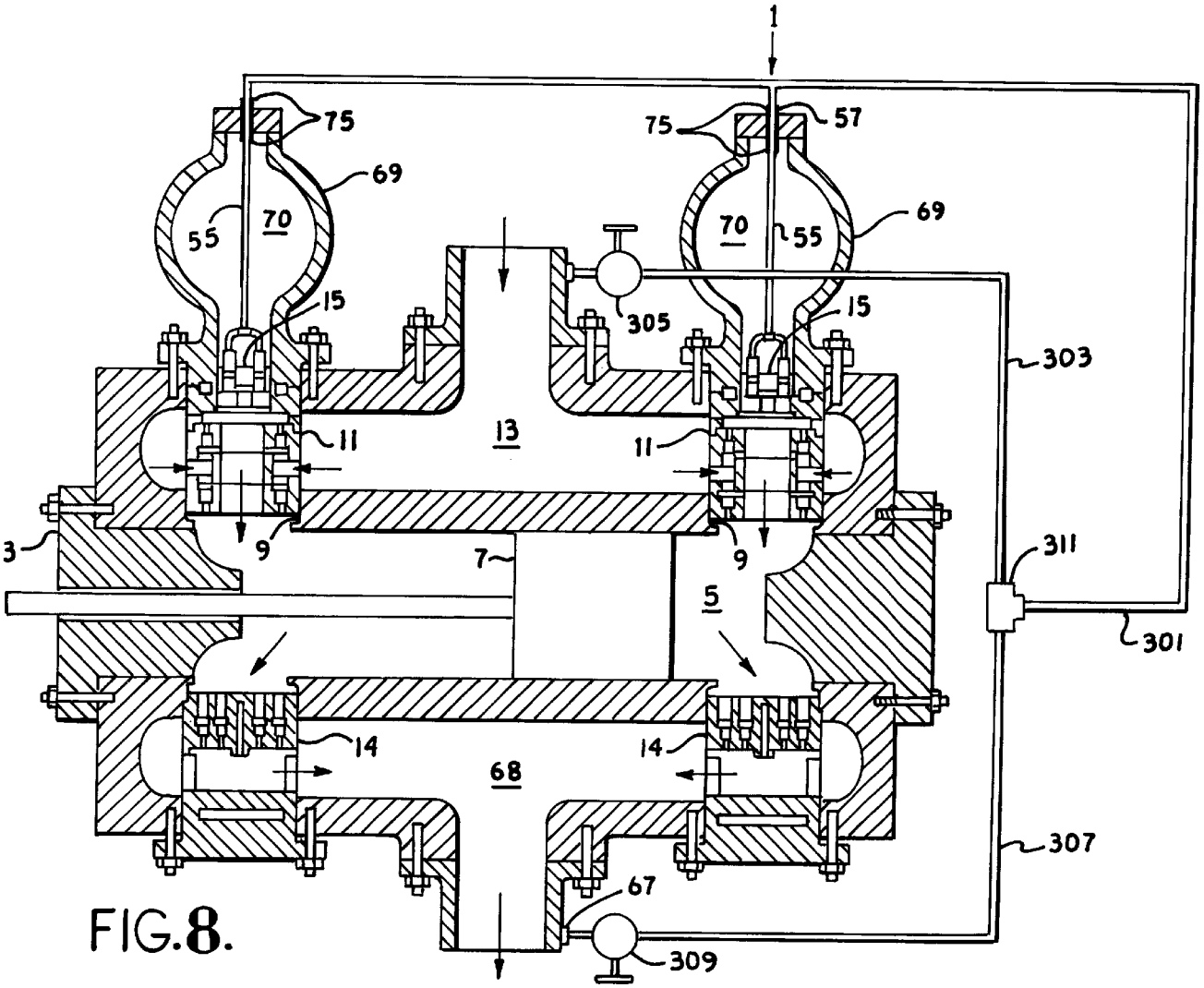
FIG. 8 is a cross-sectional view of a reciprocating gas compressor showing an alternative split pressure source control system for the unloader system.

In the system 1 described above, the control pressure $P_{ctrl}$ is provided by a pressure regulator 65 which is fed from a single pressure source 67, such as the discharge line 68 of the compressor 3. An alternative way to provide the control pressure $P_{ctrl}$ is through a split pressure source control system 301 as shown in FIG. 8. The system 301 generally comprises a first pressure line 303 which is in fluid communication with the suction line 13 of the compressor 3 through a first valve or regulator 305 and a second pressure line 307 which is in fluid communication with the discharge line 68 through a second valve or regulator 309. The pressure lines 303 and 305 are connected through a tee fitting 311 to the control manifold 55.

By manipulating the valves 305 and 309, the control pressure $P_{ctrl}$ in the control manifold 55 can be set to any pressure between the suction pressure $P_{suct}$ and the discharge pressure $P_{disc}$. The valves 305 and 309 thus act in combination as a pressure regulator for the system 301. For Example, if the first valve 305 is fully closed and the second valve 309 is fully open, the control pressure $P_{ctrl}$ in the manifold 55 will be the discharge pressure $P_{disc}$ which will cause the valve members 41 to remain closed throughout the compressor cycle, resulting in-the compressor 3 being fully loaded. Similarly, if the first valve 305 is fully open and the second valve 309 is fully closed, the control pressure $P_{ctrl}$ in the manifold 55 will be the suction pressure $P_{suct}$ which will cause the valve members 41 to remain open throughout the compressor cycle, giving the compressor 3 the maximum possible clearance volume.

Control pressures intermediate the suction pressure $P_{suct}$ and the discharge pressure $P_{disc}$ can be achieved by opening the valves 305 and 309 in varying combinations. Assuming that the pressure lines 303 and 307 are of equal lengths and diameters, fully opening both valves 305 and 309 will result in a control pressure $P_{ctrl}$ which is halfway between the suction pressure $P_{suct}$ and the discharge pressure $P_{disc}$. Partially opening both of the valves 305 and 309 can produce control pressures $P_{ctrl}$ anywhere between the suction pressure $P_{suct}$ and the discharge pressure $P_{disc}$.

The split pressure source control system 301 is particularly useful because it has been found that in operation of the system 1, pressurized gas from the compressor cylinder 5 can sometimes leak past the valve members 41 and overpressurize the control system 54. This leakage can raise the control pressure $P_{ctrl}$ above the desired set point and adversely effect the operation of the system 1. The control pressure $P_{ctrl}$ will eventually build until it reaches the discharge pressure $P_{disc}$, at which point the valve members 41 will cease to open and close, leaving the compressor 1 locked in a fully loaded condition.

If the discharge line 68 is used as the sole pressure source 67 for the control system 54, then there is no inherent way to control this pressure build-up. The split pressure source control system 301, however, allows unwanted pressure in the control manifold 55 to be released into the suction line 13 through the first pressure line 303. This prevents any build up of pressure that would adversely effect the operation of the valve members 41.

It should be noted that the valves 305 and 309 of the system 301 may be either manual valves, such as needle valves, or may be solenoid valves which can be electronically controlled. In addition, the two separate valves 305 and 309 could be replaced by a single three-way valve (not shown) mounted in place of the tee fitting 311. The three-way valve could also be either manually or electronically controlled.

IX. Back Pressure Regulation

A second way to deal with pressure build-up in the control system 54 of the apparatus 1 caused by leakage past the valve members 41 is to regulate the control pressure $P_{ctrl}$ by adapting the pressure regulator 65 to selectively release pressure from the control system 54. The regulator 65 thus maintains the desired control pressure $P_{ctrl}$ by acting as a relief valve for the control system 54. A relief line (not shown) may be added between the pressure regulator 65 and the suction line 13 so that gas released by the regulator 65 can be vented back into the suction line 13, instead of being released into the atmosphere.

X. Applications

Figure 9:
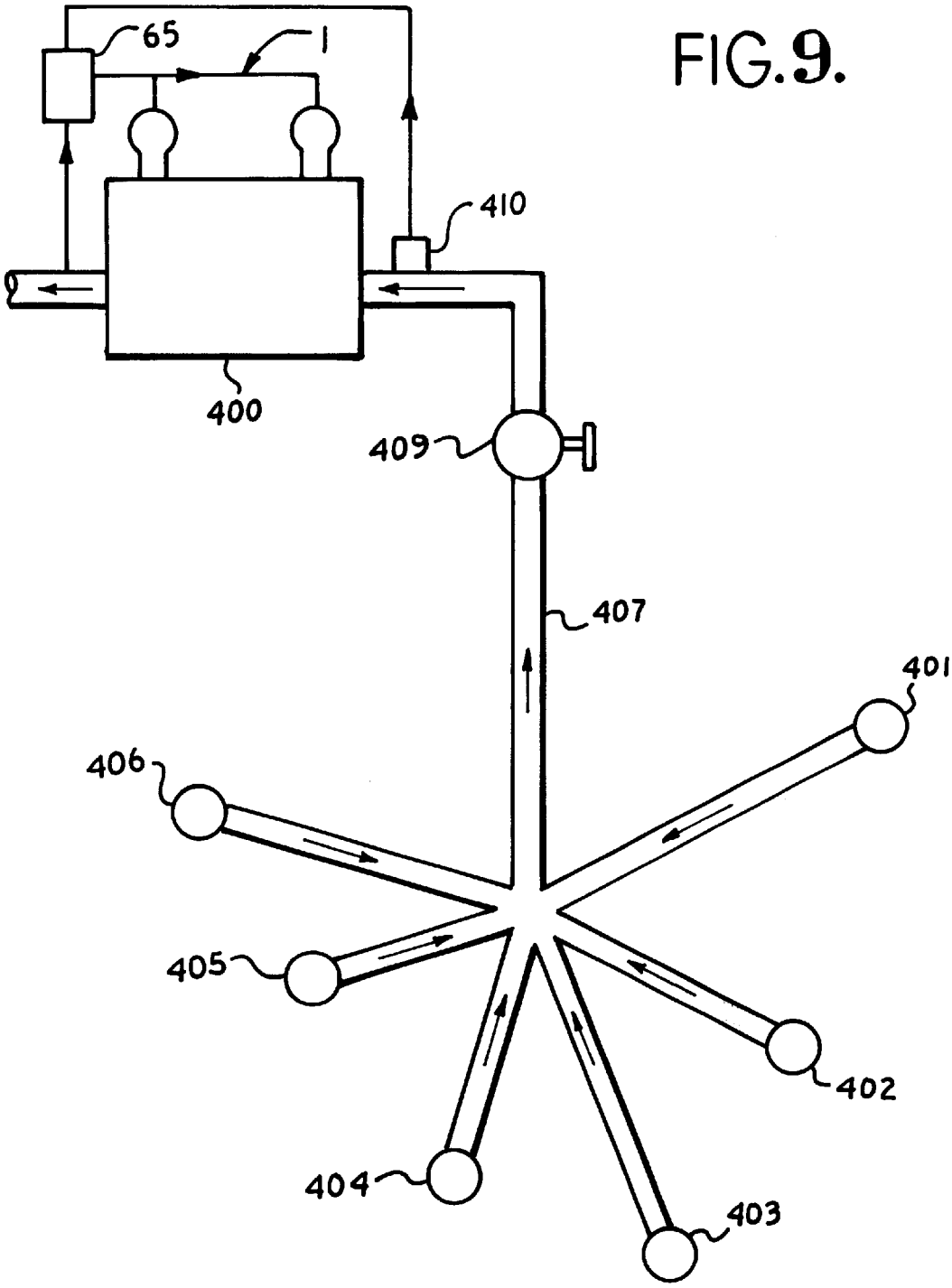
FIG. 9 is a schematic diagram showing application of the present invention to a gathering area compressor.

One application to which the present invention is particularly well adapted is usage on a gathering area compressor 400 such as is schematically depicted in FIG. 9. A gathering area compressor 400 generally receives gas from a plurality of wellheads, such as the six wellheads 401–406 depicted, through a suction line 407. The wellheads 401–406 deliver gas at different pressures, and pressure in the suction line 407 can vary significantly as individual ones of the wellheads 401–406 are taken on and off line. A conventional compressor 400 cannot adapt to changes in suction pressure $P_{suct}$. In particular, if the suction pressure $P_{suct}$ becomes too high, the compressor 400 will be overworked. In order to prevent the suction pressure $P_{suct}$ at the compressor 400 from rising too high, a suction control valve 409 is placed in the suction line 407 upstream from the compressor 400. The suction control valve 409 acts as a restriction which lowers the pressure in the line 407 to a level at which the compressor 400 can operate. Usage of a suction control valve 409 with a gathering area compressor 400 is terribly inefficient because any reduction in pressure created by the valve 409 must be made up for by the compressor 400 by recompressing the gas.

The need for a suction control valve 409 can be eliminated by adding an unloader system according to the present invention, such as the system 1, to the compressor 400 and placing a sensor 410 in the suction line 407 which communicates the suction pressure $P_{suct}$ to the pressure regulator 65. The regulator 65 can then vary, the control pressure $P_{ctrl}$ to load or unload the compressor 400 to match the suction pressure $P_{suct}$. As the suction pressure $P_{suct}$ rises, the regulator 65 can lower the control pressure $P_{ctrl}$ so as to partially unload the compressor 400 and prevent it from being overworked.

Figure 10:
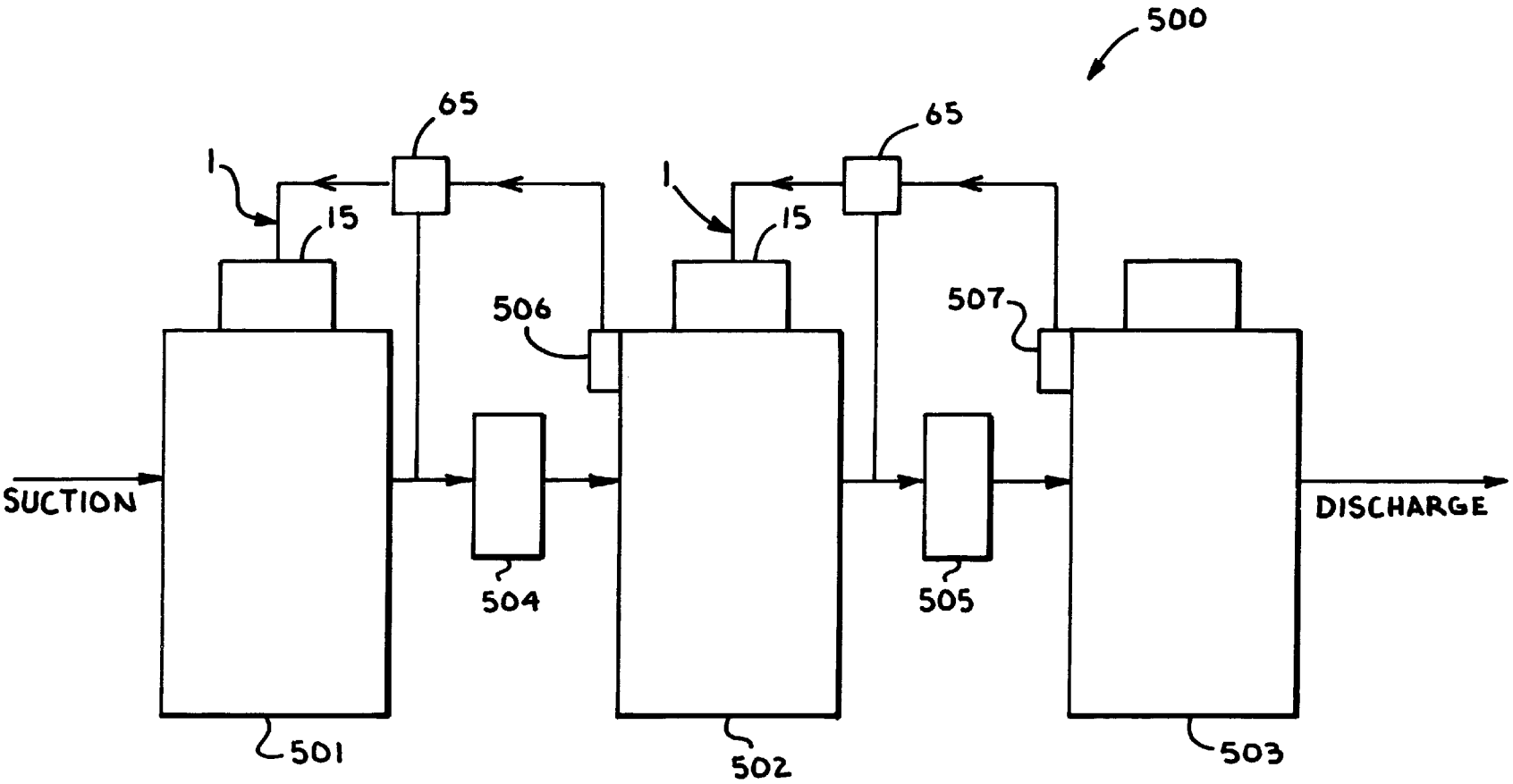
FIG. 10 is a schematic diagram showing application of the present invention to a multi-stage compressor.

Multi-stage compressors, such as the three stage compressor 500 schematically depicted in FIG. 10 are also ideal candidates for an unloader system according to the present invention, such as the system 1. The compressor 500 includes a first stage 501, a second stage 502 and a third stage 503. The stages 501, 502, and 503 may be driven off of a common crankshaft so as to run at the same speed, or they may be driven by separate motors. Gas is compressed by the first stage 501 and then flows through a first intercooler 504 to the second stage 502 where it is further compressed. Similarly, gas flows from the second stage 502 through a second intercooler 505 to the third stage 503 where it is compressed yet again before being discharged.

In multi-stage compressors, it is important that each stage not overwork the next downstream stage, i.e. the first stage 501 of the compressor 500 cannot compress the fluid to a level which will overwork the second stage 502 and the second stage 502 cannot compress the fluid to a level which will overwork the third stage 503.

If the first stage 501 is equipped with the unloader system 1, a sensor 506 can be placed on the second stage 502 to read a condition of the second stage 502, such as fuel flow rate, fuel pressure, etc. which is indicative of its workload. The sensor 506 communicates this information to the pressure regulator 65 controlling the unloader system 1 of the first stage 501. The regulator 65 can then unload the first stage 501 as necessary to prevent overworking the second stage 502. Similarly, the second stage 502 can be fitted with an unloader system 1*a* identical to the system 1 installed on the first stage 501. The system 1*a* includes a sensor 507 which reads a condition of the third stage 503. The sensor 507 communicates this information to a pressure regulator 65*a* controlling the unloader system 1*a* of the second stage 502. The regulator 65*a* can then unload the second stage 502 as necessary to prevent overworking the third stage 503.

It should be noted that the pressure regulator or controller 65 used in an unloader system according to the present invention can receive input from more than one sensor and use the information provided by the sensors sequentially to determine the optimum clearance volume for the respective compressor. For example, if the three stage compressor 500 were used as a gathering compressor 400 as described above, the regulator 65 of the first stage 501 could receive control information from both a sensor 410 in the suction line 407 and a sensor 506 on the second stage 502. The controller would first use the information from the sensor 407 to unload the first stage 501 to the extent necessary not to overwork the first stage 501. Information from the sensor 506 would then be taken into account and the first stage 501 would be further unloaded if necessary to prevent overworking the second stage 502. Additional sensors reading other control variables can be added as required.

What is claimed and desired to be secured by Letters Patent is as follows:

1. An unloader system for a reciprocating compressor including a cylinder, a piston reciprocally mounted in the cylinder, a suction line, a discharge line, a suction valve assembly and a discharge valve assembly for selectively communicating the suction and discharge lines respectively with the compressor cylinder, said unloader system comprising:

a) a clearance cavity in communication with the compressor cylinder though a passageway;

b) an unloader valve having a valve member moveable between open and closed positions and controlling flow through said passageway, said valve member having opposed first and second ends, said first end being acted on by pressure in the compressor cylinder, said pressure producing a first force which acts to urge said valve member toward said open position;

c) a pressure source;

d) a conduit communicating said pressure source with said valve member second end; and e) a pressure regulator connected to said conduit; wherein f) pressure from said pressure source is selectively varied by said pressure regulator to create a control pressure which acts on said second end of said valve member to produce a second force acting in opposition to said first force, said second force acting to urge said valve member toward said closed position, said valve member moving to said open position when said first force exceeds said second force and moving to said closed position when said second force exceeds said first force.

2. The unloader system as in claim 1 wherein said pressure source is a first pressure source, said pressure regulator is further in communication with a second pressure source, and said regulator balances pressure from said first and second sources to create said control pressure.

3. The unloader system as in claim 2 wherein said first pressure source is the compressor discharge line and said second pressure source is the compressor suction line.

4. The unloader system as in claim 1 and further including a sensor adapted to read an operating condition of the compressor and communicate a signal indicative of the operating condition to said pressure regulator, wherein said regulator may vary said control pressure in response to said signal.

5. The unloader system as in claim 4 wherein said sensor reads suction line pressure and, as the suction line pressure increases above a predetermined level, said regulator lowers said control pressure to decrease loading of the compressor.

6. The unloader system as in claim 1 wherein said pressure regulator controls said control pressure by releasing excess pressure from said conduit.

7. An unloader system for a reciprocating compressor including a cylinder, a piston reciprocally mounted in the cylinder, a suction line, a discharge line, a suction valve assembly and a discharge valve assembly for selectively communicating the suction and discharge lines respectively with the compressor cylinder, said unloader system comprising:

a) a clearance cavity in communication with the compressor cylinder though a passageway;

b) an unloader valve having a valve member moveable between open and closed positions and controlling flow through said passageway, said valve member having opposed first and second ends, said first end being acted on by pressure in the compressor cylinder, said pressure producing a first force which acts to urge said valve member toward said open position;

c) a conduit in communication with said valve member second end;

d) a first pressure line in communication with the compressor suction line and said conduit;

e) a first valve controlling flow through said first pressure line;

f) a second pressure line in communication with the compressor discharge line and said conduit; and g) a second valve controlling flow through said second pressure line; wherein h) said first and second valves are adapted to selectively balance pressure from the compressor discharge line with pressure from the compressor suction line to create a control pressure which acts on said second end of said valve member to produce a second force acting in opposition to said first force, said second force acting to urge said valve member toward said closed position, said valve member moving to said open position when said first force exceeds said second force and moving to said closed position when said second force exceeds said first force.

8. The unloader system as in claim 7 wherein said conduit communicates with said first pressure line and said second pressure line through a tee fitting.

9. In a multistage compressor having a downstream stage and an upstream stage, wherein each stage includes a cylinder, a piston reciprocally mounted in the cylinder, a suction line, a discharge line, a suction valve assembly and a discharge valve assembly for selectively communicating the suction and discharge lines respectively with the cylinder, an unloader system comprising:

a) a clearance cavity in communication with the cylinder of the upstream stage though a passageway;

b) an unloader valve having a valve member moveable between open and closed positions and controlling flow through said passageway, said valve member having opposed first and second ends, said first end being acted on by pressure in the cylinder of the upstream stage, said pressure producing a first force which acts to urge said valve member toward said open position;

c) a pressure source;

d) a conduit communicating said pressure source with said valve member second end; and e) a pressure regulator connected to said conduit; and f) a first sensor reading an operating condition of the downstream stage indicative of the workload of the downstream stage, said first sensor communicating a first signal to said pressure regulator indicative of the operating condition; wherein g) pressure from said pressure source is selectively varied by said pressure regulator in response to the first signal to create a control pressure which acts on said second end of said valve member to produce a second force acting in opposition to said first force, said second force acting to urge said valve member toward said closed position, said valve member moving to said open position when said first force exceeds said second force and moving to said closed position when said second force exceeds said first force, said regulator lowering said control pressure to decrease loading of said upstream stage when the first signal indicates that the workload of said downstream stage has risen above a predetermined level.

10. The unloader system as in claim 9 and further including a second sensor adapted to read an operating condition of the upstream stage and communicate a second signal indicative of the operating condition to said pressure regulator, wherein said regulator may vary said control pressure in response to said second signal.

11. The unloader system as in claim 10 wherein said second sensor reads suction line pressure and as the suction line pressure increases above a predetermined level, said regulator lowers said control pressure to decrease loading of the upstream stage.

12. The unloader system as in claim 11 wherein said regulator first varies said control pressure in response to said second signal and then sequentially varies said control pressure in response to said first signal.

* * * * *